United States Patent [19]

Leifeld et al.

[11] 4,199,843

[45] Apr. 29, 1980

[54] APPARATUS FOR PRODUCING A UNIFORM CONTINUOUS CARD SLIVER

[75] Inventors: Ferdinand Leifeld, Kempen; Wolfgang Beneke; Hermann Trützschler, both of Mönchen-Gladbach, all of Fed. Rep. of Germany

[73] Assignee: Trützschler GmbH & Co. KG, Mönchen-Gladbach, Fed. Rep. of Germany

[21] Appl. No.: 874,356

[22] Filed: Feb. 1, 1978

[30] Foreign Application Priority Data

Feb. 2, 1977 [DE] Fed. Rep. of Germany ..... 2704241

[51] Int. Cl.[2] ..... D01H 5/32

[52] U.S. Cl. ..... 19/240

[58] Field of Search ..... 19/240, 105, 23

[56] References Cited

U.S. PATENT DOCUMENTS

| | | | |
|---|---|---|---|
| 3,256,569 | 6/1966 | Draving | 19/240 X |
| 3,474,501 | 10/1969 | Jeanmaire | 19/105 |
| 3,562,866 | 2/1971 | Roberson et al. | 19/105 X |
| 3,709,406 | 1/1973 | Binder et al. | 19/240 X |
| 3,852,848 | 12/1974 | Feller | 19/240 |
| 4,075,739 | 2/1978 | Staheli | 19/240 |
| 4,099,297 | 7/1978 | Hasegawa et al. | 19/240 |

FOREIGN PATENT DOCUMENTS

| | | | |
|---|---|---|---|
| 2050111 | 4/1971 | Fed. Rep. of Germany . | |
| 1952829 | 5/1974 | Fed. Rep. of Germany . | |
| 2359917 | 6/1974 | Fed. Rep. of Germany . | |
| 490526 | 6/1970 | Switzerland . | |
| 930873 | 7/1963 | United Kingdom | 19/240 |
| 500296 | 4/1976 | U.S.S.R. | 19/240 |

*Primary Examiner*—Louis Rimrodt
*Attorney, Agent, or Firm*—Spencer & Kaye

[57] ABSTRACT

In the production of a card sliver in a textile fiber carding machine, the rate at which fibers are fed to the machine is continuously measured and deviations in the measured rate from a desired value are utilized to vary the rate at which fibers are being supplied to the machine.

5 Claims, 2 Drawing Figures

APPARATUS FOR PRODUCING A UNIFORM CONTINUOUS CARD SLIVER

BACKGROUND OF THE INVENTION

The present invention relates to a method for producing a uniform, continuous band of fibers in which the deviation of the actual value of the quantity of fibers in the band from a given desired value is utilized to regulate the rate at which fibers are introduced into a carding machine.

In order to make the card sliver leaving the carding machine more uniform with respect to its cross-sectional shape, it is known to employ a comparison signal to vary the speed ratio between card input and card output at least one location, and thus to vary the dwell time within the carding machine. For this purpose, a meaasuring element furnishes a signal which is proportional to the cross section of the sliver. An amplified signal representative of long term fluctuations in such cross section acts on a regulatable drive so as to control the rate of rotation, for example of a feed roller in that it is decelerated when there is too much material and is accelerated when there is a deficiency of material. The feed roller receives the fiber material from a scrutcher lap, or beater.

One drawback of this method is that it requires complicated apparatus. A further drawback is that it is not always possible to arbitrarily change the rate of rotation of the machine parts which transport the fiber material. Since the card with all its parts is adjusted to a certain optimum mode of operation and deviations can be taberated only within very close limits, considerable difficulties may develop during processing.

In a known process disclosed in German Auslegeschrift (Published patent application) No. 1,510,302, a carding machine is associated with a measuring device which monitors the length of silver leaving the machine and being delivered to a roving can and acts to cause each can to be filled with a selected length of silver. After each can has been thus filled, it is weighed and whenever the measured weight falls outside of a desired weight range, the rate of delivery of fibers to the carding machine is subsequently altered in a direction to bring the weight of subsequently filled cans into the desired range.

Of course, this method entails long lapses of time between production of sliver with a weight outside of the desired range and effectuation of a correcting adjustment. Only one correction indication is produced for each silver length serving to fill a roving can. Fluctuations occurring during production of such a length of sliver can not be corrected and if the weight, or cross section, of a silver fluctuates, during the filling of a single can, about a value in the desired weight range, this will go entirely undetected even though silver portions of appreciable length may have sizes, i.e., weights per unit length, or cross sections, which deviate considerably from the desired range. In other words, it is perfectly possible, when practicing this known method, to produce a silver having substantial portions with an unacceptably large or small cross section without producing any indication that could serve to correct the condition.

SUMMARY OF THE INVENTION

It is an object of the present invention to provide a method of the above-described type which is less complicated with respect to the equipment involved and permits regulation of the lap thickness without changing the speed of parts of the carding machine and thus the rate of travel of fibers through the machine.

Another object of the invention is to permit continuous monitoring of the thickness of the card sliver and continuous adjustment of the rate of delivery of fibers to the carding machine in a manner to correct deviations in the card sliver thickness. These and other objects are achieved, according to the invention, in a method for producing a card sliver in a carding machine to which fibers are supplied by a rotatable delivery device having an adjustable rate of rotation and delivering fibers at a rate determined by its rate of rotation, which method includes measuring the rate at which fibers are being supplied to the carding machine, and varying the rate at which fibers are delivered in a direction to correct for deviations in the measured rate from a desired value, by carrying out the step of measuring while the carding machine is operating to produce the sliver and in a manner to produce, in a regulating member, a control signal representative of such deviation, and by carrying out the step of varying by means of a setting member which is continuously responsive to the control signal for controlling a setting member which continuously adjusts the rate of rotation of the delivery device.

In contradistinction to the known methods in which the regulation of long period fluctuations of the cross section is effected by a change in the amount of fiber material put in at the entrance of the card the setting member according to the invention changes the rate at which fiber is furnished from a delivery device. Thus it is possible in a simple manner to regulate the sliver size without changing the speed of parts of the carding machine. The method permits the adjustment in the quantity of fibers to be effected upstream of the carding machine so that the quantity of fibers furnished thereto is influenced already in an early production stage.

Advantageously the actual value of the quantity of fibers per unit length can be measured upstream of the carding cylinder so as to establish a regulating circuit of short length.

The present invention also includes an apparatus for practicing the method. This apparatus is characterized by the fact that a regulator is in communication with a setting device which is driven at a constant speed by the feed roller for the card and whose driven end is used to infinitely regulate the rate of rotation of a delivery device. By incorporating the setting device it is possible to eliminate the need for varying the speed of the feed roller itself. At the same time the regulating device influences the output of the setting device so that the delivery device which is in communication with the driven end of the setting device can be regulated infinitely, i.e., over a continuous range.

If the fibers are supplied from a lap pneumatically, the delivery device is constituted by the delivery rollers of a feed shaft. According to an advantageous embodiment, the width of the feed shaft can be regulated in addition to the speed of the delivery device. This permits a change in the thickness of the material supplied.

If the card is arranged downstream of a beater machine, the delivery device is provided in the form of a device for unrolling the lap which constitutes the source of fibers for the carding machine.

When a three-point regulator is used, the amount of apparatus required can be reduced significantly so that the apparatus according to the invention can be produced very economically.

If the setting device is provided with a setting motor, it is possible to achieve a time controlled regulation. According to a further suitable embodiment, the setting device has a stepping motor so that the regulation can be path controlled.

DESCRIPTION OF THE PREFERRED EMBODIMENTS

Figure 1:
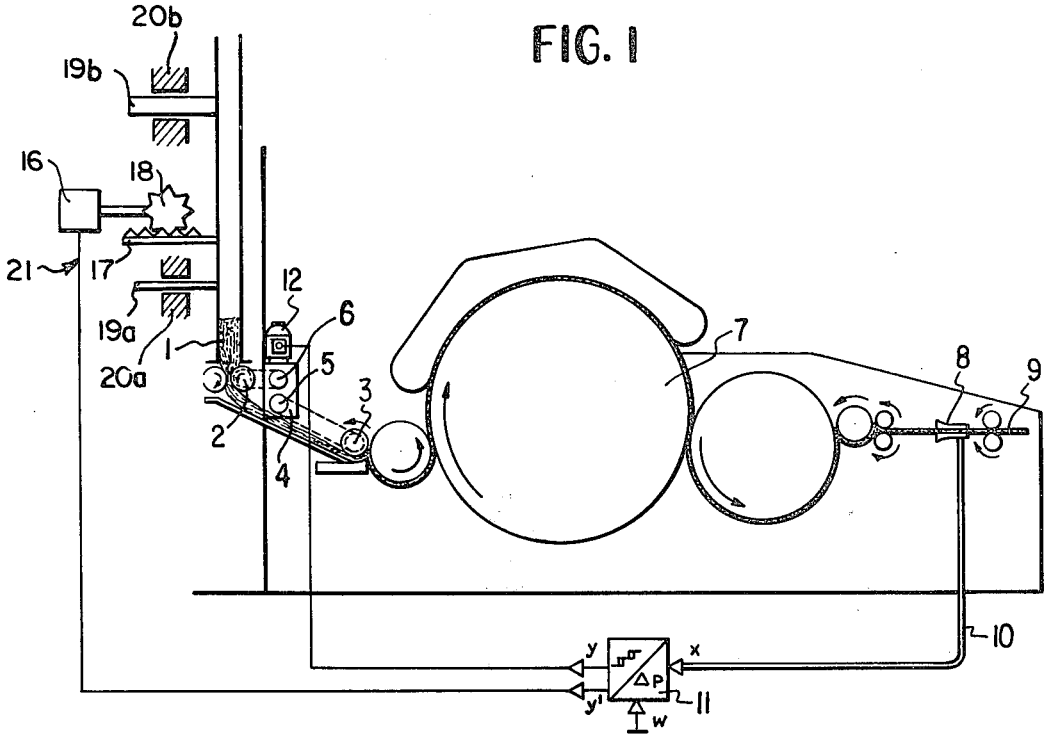
FIG. 1 is a simplified pictorial side elevational view of a carding machine equipped with a system according to a first preferred embodiment of the invention.

FIG. 1 is a side view of an apparatus according to the invention in which the measuring member is disposed downstream of the carding cylinder and the delivery is constituted by delivery rollers at the outlet, or lower, end of a fiber tuft feed shaft.

Figure 2:
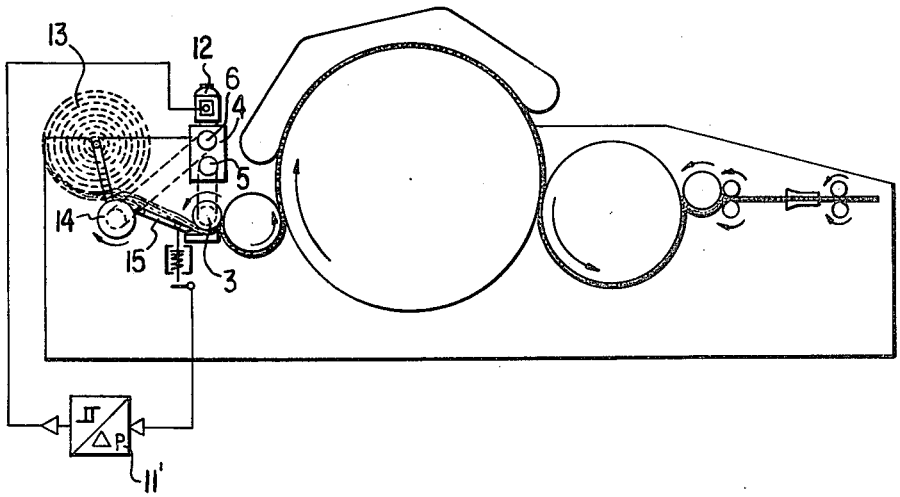
FIG. 2 is a view similar to that of FIG. 1 illustrating a second preferred embodiment of the invention.

FIG. 2 is a side view of an apparatus according to the invention in which the measuring member is disposed upstream of the carding machine proper, i.e., upstream of its associated feed roll, and the delivery device is provided in the form of an unrolling device for a rolled fiber lap.

FIG. 1 is a schematic representation of a carding machine of known design. The textile fiber tufts are removed from a feed shaft 1 by delivery rollers 2 and are fed to the feed roll 3 of the machine. Between the delivery rollers 2 and the feed roll 3 there is disposed a setting member 4, e.g., a variable speed gear assembly.

The setting device 4 is driven at a constant speed by the feed roll 3, which is connected to the driving end 5 of device 4. At its driven end 6, the setting device 4 may drive, via a connection, the delivery rollers 2 of the feed shaft.

At the side of the carding cylinder 7 opposite the intake side, the textile fiber web produced in the machine is drawn through a trumpet 8 which forms the web into a sliver 9. The trumpet 8 is here designed as a measuring member and furnishes a pneumatic signal x corresponding to the cross section of the sliver 9, via a measuring line 10, to a three-point regulator 11. Regulator 11 produces an electrical signal y which corresponds to long-period fluctuations in the cross section of sliver 9 and supplies that signal to control a setting motor 12 of the setting device 4. Thus the speed of the driven end 6 varies the speed of the delivery rollers 2 of the feed shaft 1.

In this way, fiber tufts are removed from the feed shaft 1 at a higher rate if the cross section of sliver 9 is too small and fiber tufts are removed from feed shaft 1 and supplied to feed roll 3 at a lower rate if the cross section of sliver 9 is too large.

The width of feed shaft 1 can also be varied, as by a controllable cylinder piston unit or linkage mechanism 21, which can be connected to be controlled by the output signal from regulating device 11.

FIG. 2 shows an apparatus according to the invention in which the textile fiber tufts are removed in the form of a fiber lap from a roll 13 by means of an unrolling device 14 and are fed to the feed roll 3. The setting device 4 is diposed between the unrolling device 14 and the feed roll 3 and corresponds in structure to that of FIG. 1. A weighing device 15 is furthermore disposed between the unrolling device 14 and the feed roll 3. This weighing device 15 furnishes a signal corresponding to the actual weight of the textile fiber lap to a regulator 11'. The electrical output signal from regulator 11' acts on the setting motor 12 of the setting member 4. Thus the speed of the unrolling device 14 is varied by controlling the speed of the driven end 6 of setting device 4.

One suitable arrangement for monitoring the sliver at trumpet 8 is disclosed in Lothar Simon, *Pneumatische Messwertaufnahme in der Spinnereivorbereitung* (Pneumatic Measurement Sensing for the Preparation of Spinning), TEXTILTECHNIK, Vol. 25, 1975, Issue 12, pages 759–64.

The three-point regulator 11 and the two-point regulator 11' are regulators which are known per se. The signal x, the regulating value, is the input value of the three-point regulator 11 or the two-point regulator 11', respectively, where it is compared with a given desired value w. Leaving the three-point regulator 11 or the two-point regulator 11', respectively, the signal y acts on the setting motor 12 as a regulating value.

The setting member 4 substantially includes a known control gear assembly as well as the setting motor 12. This control gear assembly is arranged so that the shaft journal at the input of the control gear assembly (see position 5) is driven by the feed roll 3 of the carding machine and is in synchronism therewith. The speed of the shaft journal at the output of the control gear assembly (see position 6) at which the delivery rollers 2 or the unrolling device 14 are driven is varied with the aid of setting motor 12. The setting motor 12 may be a known electric motor which continuously changes the control gear assembly, or a known stepping motor which changes the control gear assembly in stages.

Simultaneously with the change in speed of the delivery rollers 2 of the feed shaft 1 or the unrolling device 14, possibly also independently of this change or without any change in speed, the width of the feed shaft 1 can be increased or decreased, this adjustment being effected by means of an electric motor, pneumatically or hydraulically. Constricting the feed shaft 1 reduces the quantity of fibers fed to the carding machine. An increase in the size of the feed shaft 1 causes the quantity of fibers fed to the feed roll 3 for the carding machine to be increased. A change in the width of the feed shaft is effected, for example, by means of the mechanical adjustment mechanism 21 shown in FIG. 1 which includes a toothed rod 17, a toothed wheel 18 and a motor 16. At the outside of one wall of the feed shaft 1 there are fastened two slidable guide elements 19*a* and 19*b*, which are movably mounted in two stationary slide guides 20*a* and 20*b*. At the same outer side of the wall, there is provided the toothed rod 17 into which engages the toothed wheel 18 which is coupled together with motor 16. An amplified signal y' leaves the three-point regulator 11 and acts on motor 16. This causes the width of the feed shaft 1 to be changed via toothed wheel 18 and the toothed rod 17.

It will be understood that the above description of the present invention is susceptible to various modifications, changes and adaptations, and the same are intended to be comprehended within the meaning and range of equivalents of the appended claims.

What is claimed is:

1. In apparatus including a carding machine provided with a feed roll and arranged to produce a card sliver, a rotatable delivery device having an adjustable rate of rotation for delivering fibers to the feed roll at a rate determined by its rate of rotation, a measuring device disposed for continuously providing a measuring result representative of the size of the card sliver, a regulating device connected to receive the measuring result produced by the measuring device and to produce a control signal representative of deviations between the actual measuring result and a desired result, and a setting device connected to control the rate of rotation of the delivery device, the improvement wherein: said setting device comprises a rotatable input member connected to be driven by, and in unison with, said feed roll, a rotatable output member connected to be driven by said input member and to drive said delivery device, and means including an electric motor connected to receive the control signal from said regulating device and arranged to vary the ratio between the rotation rates of said input and output members over a continuous range as a function of said control signal in a manner to regulate the speed of said delivery device in a direction to eliminate such deviations.

2. An arrangement as defined in claim 1 further comprising a fiber feed shaft provided at its lower end with delivery rollers for supplying fiber material to said carding machine, and said delivery device is constituted by said delivery rollers

3. An arrangement as defined in claim 1 wherein said delivery means comprise an unrolling device for a fiber lap.

4. An arrangement as defined in claim 1 wherein said motor is a setting motor.

5. An arrangement as defined in claim 1 wherein said motor is a stepping motor.

* * * * *